US005481480A

United States Patent [19]

Green et al.

[11] Patent Number: 5,481,480

[45] Date of Patent: Jan. 2, 1996

[54] PROCESS CONTROL FOR PHOTOGRAPHIC PROCESSING APPARATUS

[75] Inventors: Andrew Green; Arthur E. Saunders, both of Middlesex, England

[73] Assignee: Eastman Kodak Company, Rochester, N.Y.

[21] Appl. No.: 144,167

[22] Filed: Oct. 27, 1993

[30] Foreign Application Priority Data

Nov. 28, 1992 [GB] United Kingdom ..... 9224962

[51] Int. Cl.[6] ..... G03C 5/00

[52] U.S. Cl. ..... 364/525; 430/30; 354/3

[58] Field of Search ..... 364/525; 430/30; 354/3

[56] References Cited

U.S. PATENT DOCUMENTS

| | | | |
|---|---|---|---|
| 3,462,221 | 8/1969 | Tajima et al. | 355/77 |
| 3,995,959 | 12/1976 | Shaber | 356/202 |
| 4,588,298 | 5/1986 | Nakamura | 356/443 |
| 5,063,583 | 11/1991 | Galkin | 378/207 |

OTHER PUBLICATIONS

Woodlief Thomas, Jr., *SPSE Handbook of Photographic Science and Engineering*, 1973, pp. 767–768.

*Primary Examiner*—Emanuel T. Voeltz

*Assistant Examiner*—Kyle J. Choi

*Attorney, Agent, or Firm*—William F. Noval

[57] ABSTRACT

A method of controlling photographic processing apparatus when processing a given photographic material using the characteristic curve for that material, the characteristic curve being determined from a control strip of the photographic material, the control strip being produced exposing the control strip to a step wedge, and processing the exposed strip in the processing apparatus to be controlled, the characteristic curve being determined by measuring density values from the processed control strip in relation to the exposure applied to the strip in the step wedge, and plotting these density in relation to the exposure, characterized in that the characteristic curve is defined by:

$$D=D_s/[1+(\{E_t/E\}^{\beta})/\alpha]^{\alpha}$$

where E is the exposure,

D is the density at exposure E, $E_t$ is the exposure at the point of inflexion of the curve, $D_s$ is the density at saturation, and $\alpha$ and $\beta$ are constants for the material.

By this method, precise control can be exercised over photographic processes.

1 Claim, 5 Drawing Sheets

PROCESS CONTROL FOR PHOTOGRAPHIC PROCESSING APPARATUS

FIELD OF THE INVENTION

The present invention relates to process control for photographic processing apparatus and is more particularly, although not exclusively, concerned with process control systems for automatic photographic processing machines, and the production of photographic materials.

BACKGROUND OF THE INVENTION

In order to monitor a process, and thereby to control it, it is necessary to identify parameters which reliably reflect the state of the process, and which can be conveniently measured on a regular basis. In the case of a photographic process, it is common to illustrate the photographic response of a particular film, following development in that process, by a curve, sometimes called the "characteristic curve" for the material being measured, representing the relationship between developed density and the logarithm of exposure. This curve is often referred to as the H & D curve, after Hurter and Driffield, *The Journal of the Society of Chemical Industry,* No. 5, Vol. IX, May 31, 1890.

The "characteristic curve" is determined using a control strip as is well known in the art. The control strip is produced by taking a small piece of film and exposing it in a sensitometer by contact with an original step wedge, which has, typically, 21 densities in steps of 0.15log exposure units (for X-ray films, for example), with light of a colour appropriate to the type of film being used for process control (typically either blue or green for X-ray films). The exposed strip is processed in the processor whose performance is being monitored, and is then ready to be measured.

Densities measured on the control strip are plotted against the relative log exposure, and important process control parameters from the resulting curve can be obtained which characterize the state of the process.

However, the process control parameters which are currently in use, almost universally, are not adequate descriptors of the response of the system, and in each case are themselves dependent on unmeasured variables in the system.

Moreover, in process control systems, for example the KODAK 'X-Omat' Process Control Manager, where the variability of the parameters is linked to a system for diagnosing the process, the diagnosis is limited when the variables cannot properly be separated.

It is therefore an object of the present invention to provide an improved process control system for automatic photographic processing machines.

It is a further object of the present invention to produce photographic materials based on the use of mutually exclusive control parameters which are more usefully related to the shape of the characteristic curve for the material in question.

SUMMARY OF THE INVENTION

In accordance with one aspect of the present invention, there is provided a method of controlling photographic processing apparatus when processing a given photographic material using the characteristic curve for that material, comprising the steps of producing a control strip of the photographic material by exposing the control strip to a step wedge, and processing the exposed strip in the processing apparatus to be controlled.

The method is improved in that a characteristic curve, defined by:

$$D=D_s/[1+(\{E_t/E\}^{\beta})/\alpha]^{\alpha}$$

where E is the exposure,

D is the density at exposure E, $E_t$ is the exposure at the point of inflexion of the curve, $D_s$ is the density at saturation, and $\alpha$ and $\beta$ are constants for the material, is determined by measuring density values from the processed control strip in relation to the exposure applied to the strip in the step wedge, and plotting these densities in relation to the exposure.

By this method, precise control can be exercised over photographic processes.

In accordance with another aspect of the present invention, there is provided a method of producing photographic materials using the method described above.

BRIEF DESCRIPTION OF THE DRAWINGS

For a better understanding of the present invention, reference will now be made, by way of example only, to the accompanying drawings in which.

DETAILED DESCRIPTION OF THE PREFERRED EMBODIMENT

Figure 1:
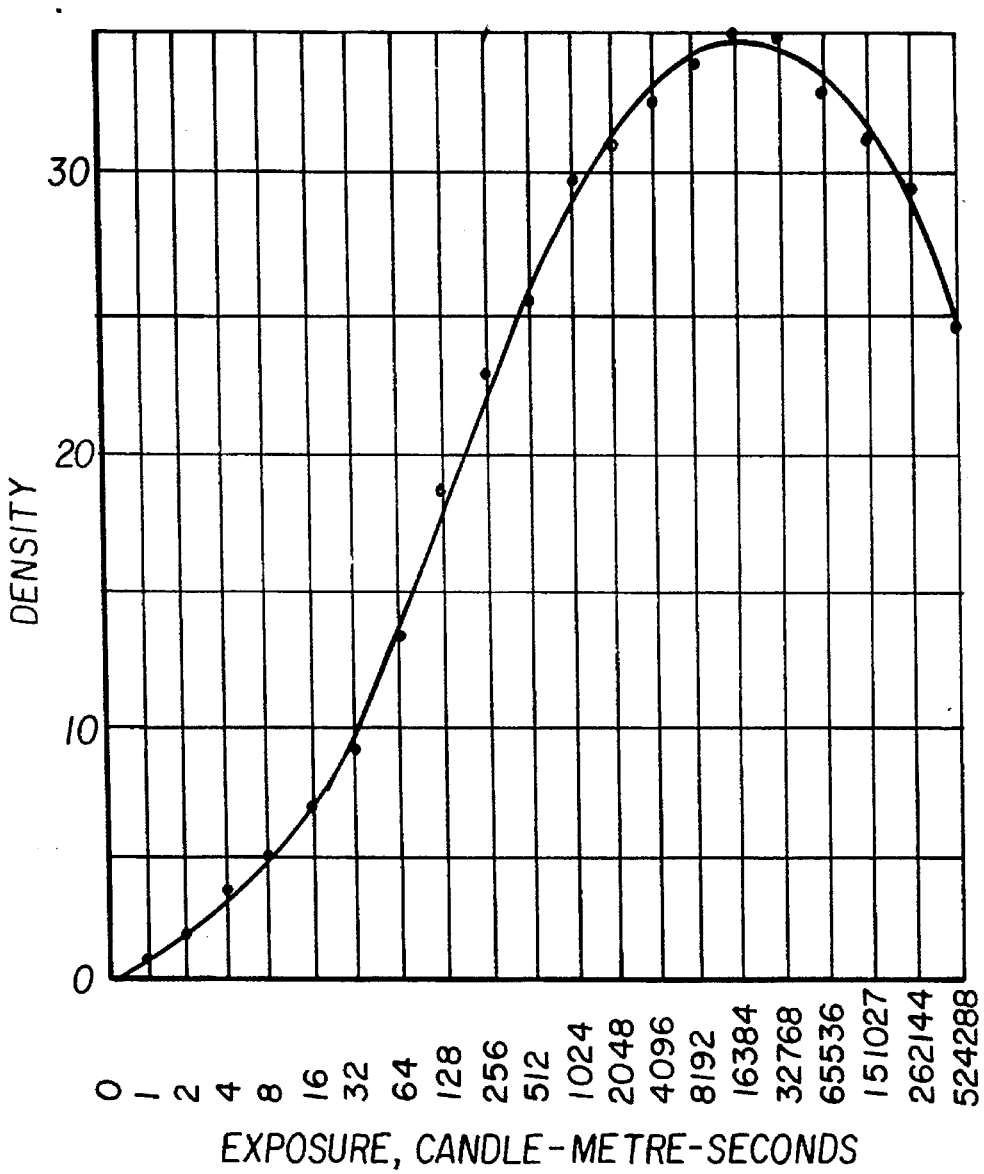
FIG. 1 (PRIOR ART)
FIG. 1 illustrates a H & D curve, after Hurter and Driffield, *The Journal of the Society of Chemical Industry,* No.5, Vol. IX, May 31, 1890.

The characteristic or H & D curve mentioned above is shown in FIG. 1.

A control strip as discussed above is shown in FIG. 2.

Figure 3:
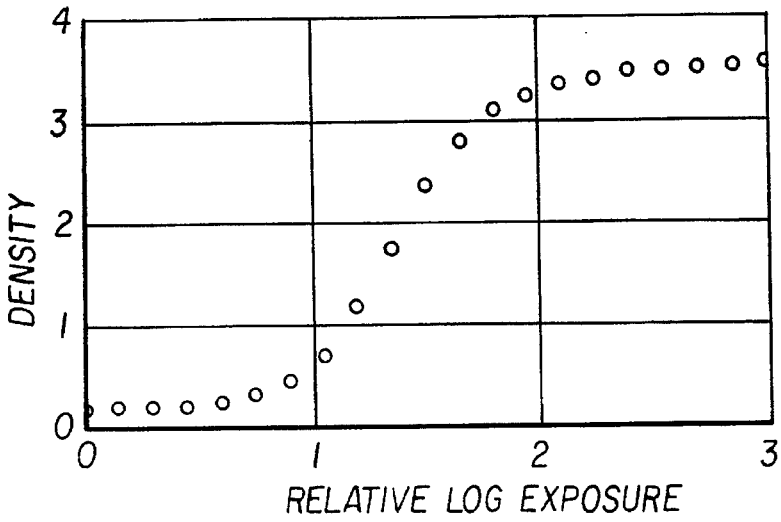
FIG. 3 (PRIOR ART)
FIG. 3 illustrates a plot of density against relative log exposure obtained from measurements taken from the strip shown in FIG. 2.

FIG. 3 shows a density-relative log exposure curve obtained by measurement (as mentioned above) from a control strip.

Figure 4:
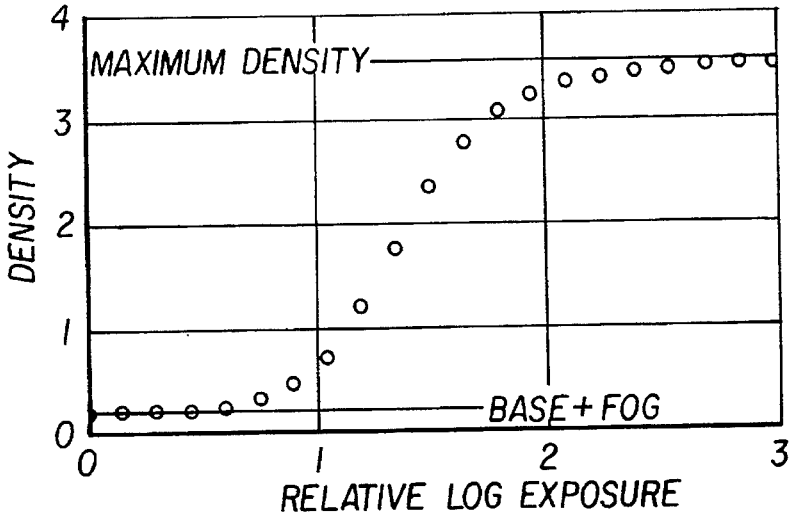
FIG. 4 (PRIOR ART)
FIG. 4 is similar to FIG. 3, but indicates minimum and maximum density.
Figure 5:
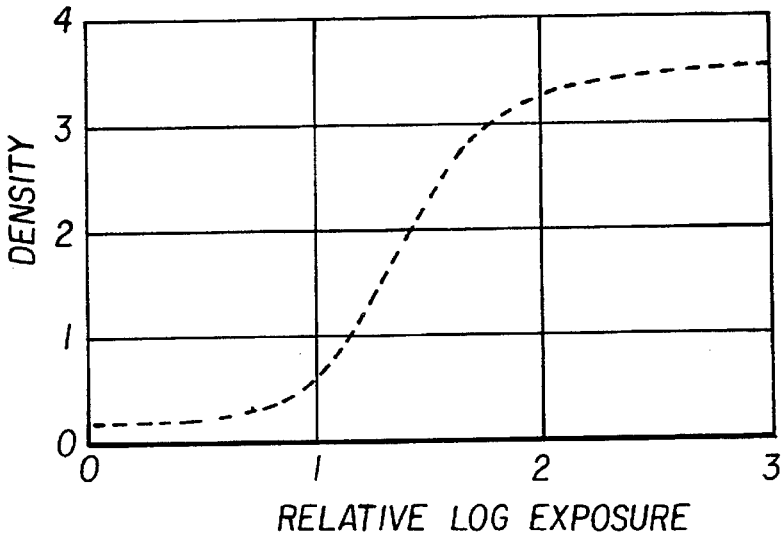
FIG. 5 (PRIOR ART)
FIG. 5 is similar to FIG. 3, but with the plotted points connected to form a curve.

Common to most means for defining characteristic curve parameters are the measurement of the minimum density (fog+film base density, preferably measured as far as possible from any exposed area) and the maximum density of the control strip. This is shown in FIG. 4. The plotted points from density-relative log exposure curve are normally connected free-hand, or by means of a suitable curve-fitting algorithm to give the plot shown in FIG. 5.

Figure 6:
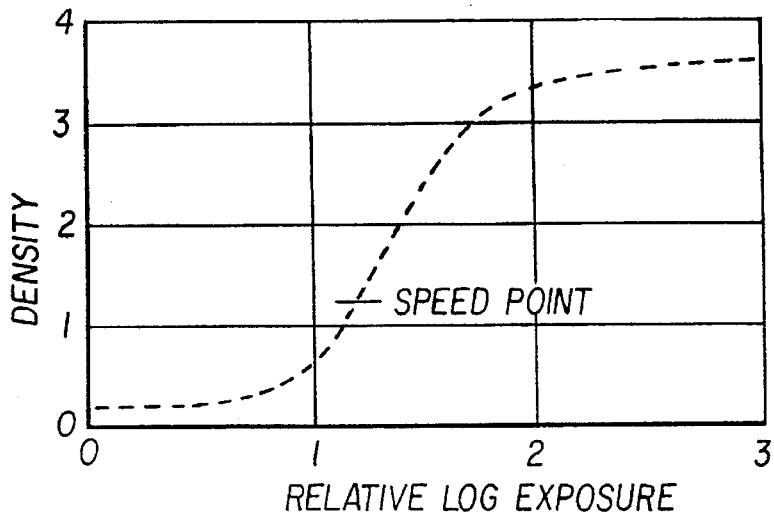
FIG. 6 (PRIOR ART)
FIG. 6 is similar to FIG. 3, but illustrating the speed point.

Speed, which indicates how much exposure must be given in order to produce a specified density, conventionally a density of 1.0 above the gross fog for X-ray films may also be common. The speed point is shown in FIG. 6. The relative speed is often calculated according to the formula:

relative speed=100(3-relative log exposure)

For the purposes of process control, this value may be normalized on the basis of the speed of a particular material, for example, KODAK 'X-Omat' S film can be arbitrarily defined as having a speed of 500, and the speeds of other materials can then be calculated relative to that.

Another way of expressing the speed for process control purposes, according to DIN 6868, is to record the density of the step whose density is closest to a density of 1.0 above the gross fog.

Figure 7:
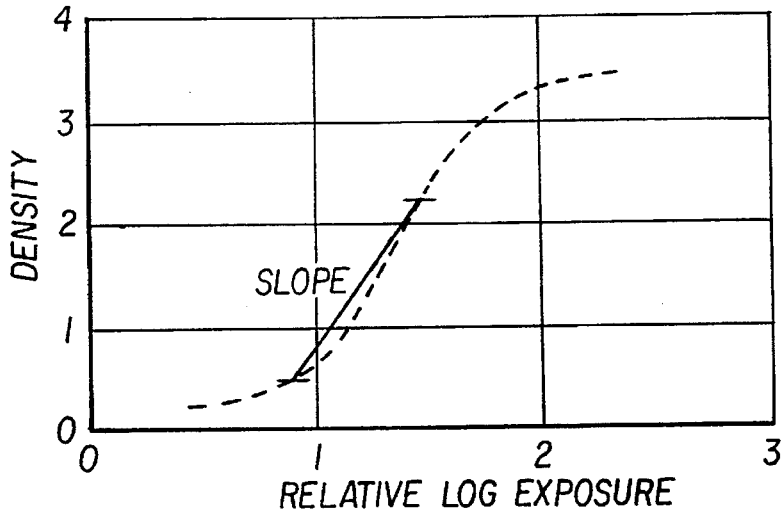
FIG. 7 (PRIOR ART)
FIG. 7 is similar to FIG. 3, but illustrating the slope.

Slope or "contrast" may also be used, which indicates the range and level of discrimination between different exposures. For normal X-ray films for example, the slope is calculated between a point having a density value of 0.25 above the gross fog, and a second point 2.00 above gross fog as is shown in FIG. 7.

There are some obvious drawbacks in the use of each of these parameters for process control, and indeed for the definition of the sensitometric response for a particular film product.

The definitions of minimum density and maximum density include the density of the film base material—which itself is a variable, not normally measured, and scarcely relevant to the performance of the film material. The definition of Maximum Density, because it involves only the maximum density obtained with a particular sensitometric exposure, and not necessarily the saturation density for that film material in the process under examination, includes the effect of unrelated variables (for example, film speed and exposure).

The history of the definition of photographic speed serves to demonstrate the dichotomy in the balance of theoretical meaning and practical use. The definition according to DIN 6868 has served for many years as a useful "rule of thumb" for process monitoring, but is scarcely related to the reality of speed. It can hardly be used for the comparison of different products, nor is it useful in diagnosing problems within the process—since it contains too many unknown variables.

The definition of a "speed point", as illustrated in FIG. 6, is a very good predictor of performance, but the density at which it is defined should, strictly speaking, be modified according to the response of the material in question and the use to which it is put. FIG. 7 amply illustrates the drawbacks in using an arbitrary definition for slope.

In addition to the position of measurement, the values measured are subject to great variability unconnected with the real shape of the "characteristic curve". In order to better describe the curve shape, the slopes of different parts of the curve are often measured and quoted.

One or more of the control parameters listed below may be used, either exclusively, or in combination, or in combination with control parameters which are currently in use or required by international standards.

Figure 2:
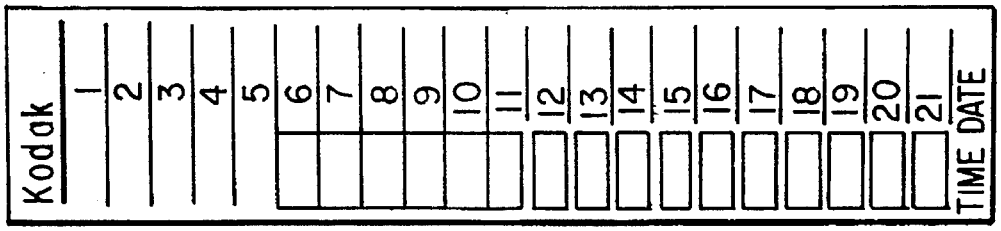
FIG. 2 (PRIOR ART)
FIG. 2 illustrates a control strip.

The definitions of the preferred control parameters, based on the measurement of a control strip of the type shown in FIG. 2 (or similar), are as follows:

Film Base Density

The mean density of the film base for each batch of film should preferably be measured, or specified by the film manufacturer together with the range of variation for that batch.

Minimum Density (Fog)

The minimum density of the control strip, less the film base density.

Maximum Density

The saturation density of the particular film material in the process in question, less the film base density. This value may also be calculated, if it cannot be measured, according to equation (3) below.

Figure 8:
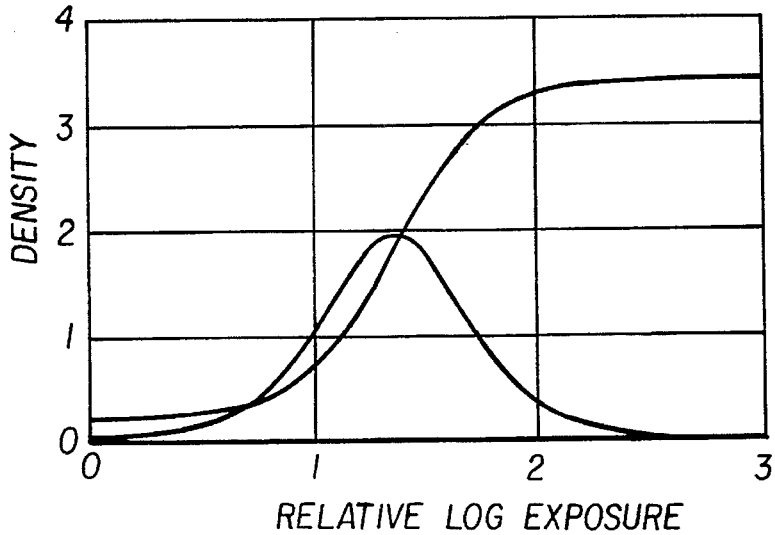
FIG. 8 illustrates the characteristic curve and its first derivative on a different scale.

Further parameters require the following calculations based on the response of the film material:

First, the derivative of the characteristic curve is calculated. FIG. 8 illustrates the typical shape of the derivative, although not on the same density scale as the original curve.

Figure 9:
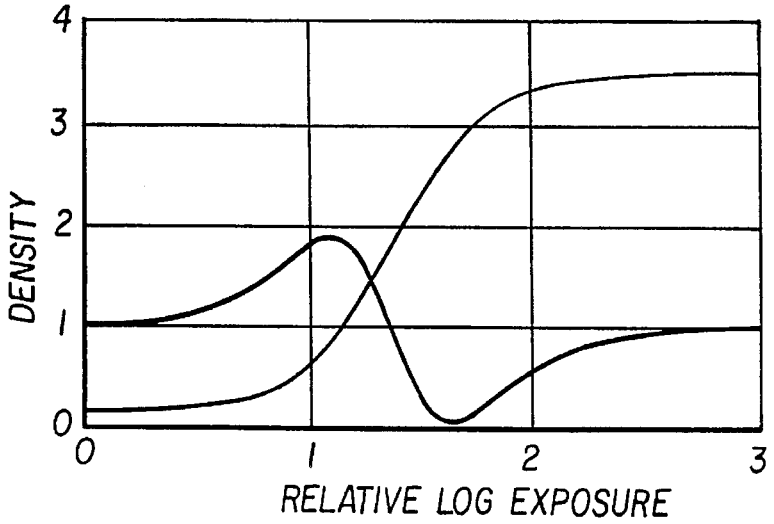
FIG. 9 illustrates the characteristic curve and its second derivative on a different scale.

Next, the second derivative of the characteristic curve is calculated. FIG. 9 illustrates the typical shape of the second derivative, although not on the same density scale as the original curve.

Figure 10:
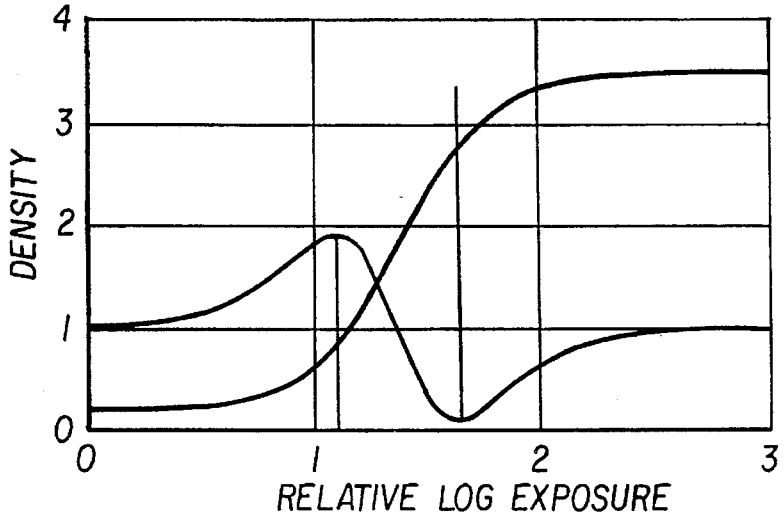
FIG. 10 is similar to FIG. 9, but illustrating the positions of the minimum and maximum values.

Finally (FIG. 10), the positions of the maximum and minimum of the second differential, on the exposure axis, are measured. For the following calculations the former is referred to as $\log E_{sp}$ and the latter as $\log E_{sh}$. The exposure values are preferably absolute, but may be relative, or normalized to a calibrated reference.

Then, the following definitions can be made:

Speed

The definition of speed depends on the value of exposure (or log exposure) for which the second differential of the H & D curve is at its maximum, see also equation (7) below. To bring the numerical value more in line with current definitions, for example:

$$\text{Speed}=100(3-\log E_{sp})$$

Slope (g)

The effective contrast may be defined as:

$$g=\frac{(\text{density at } \log E_{sh}-\text{density at } \log E_{sp})}{(\log E_{sh}-\log E_{sp})}$$

Figure 11:
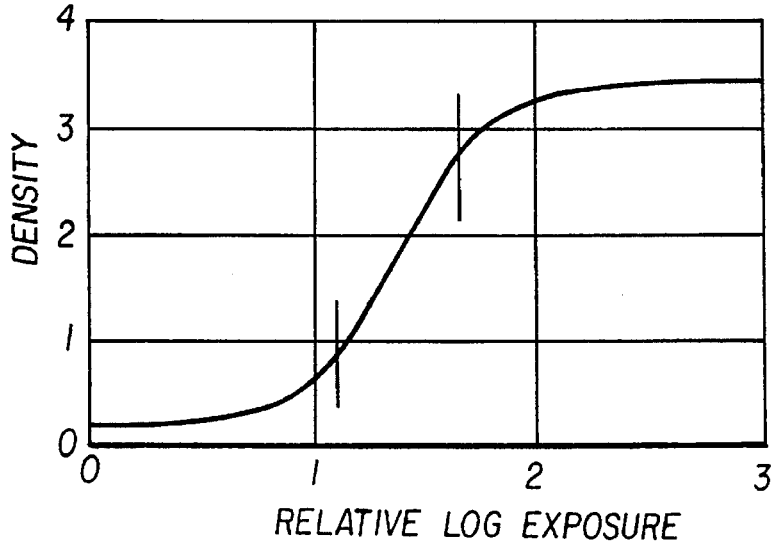
FIG. 11 is similar to FIG. 3, but illustrating the effective contrast.

The construction for this definition is illustrated in FIG. 11. (See also equation (11) below.)

Slope (γ)

It is also possible to define the contrast in a second way, as the slope at the inflection point of the H & D curve (i.e. the maximum of the first differential). (See also equation (12) below.)

Latitude λ

$$\lambda=\log E_{sh}-\log E_{sp}$$

See also equation (10) below.

In order to make a reliable calculation of parameters based on the first and second differentials of the H & D curve, it is necessary to use an analytical expression to fit the measured data.

The mathematical details underlying the preceding disclosure are as follows. The basic form of the equation to the density vs. log exposure curve used in fitting the experimental data is given by:

$$D=D_s/[1+\{E_i/E\}^{\beta}], \quad (1)$$

where

D and $D_s$ are the densities at exposure E and at saturation respectively;

$E_i$ is the exposure at the inflexion point of the curve; and

β is a constant related to the slope of the curve at the inflexion point.

The right-hand side of this equation can be immediately transformed into a function of log exposure to give:

$$D=D_s/[1+\exp(\beta' \log\{E_i/E\})] \quad (2)$$

in which β' is equal to β/logE, that is 2.3026β.

Equations (1) and (2) represent symmetrical sigmoid curves and do not accurately fit the experimental data obtained for most practical systems. It is generally found that practical materials conventionally processed exhibit an asymmetry which is characterized by the curvature at the toe of the curve being greater than that at the shoulder. If either of the expressions for $D/D_s$ obtained from the above equations is raised to some power α, a constant equal to unity or higher, then the required degree of asymmetry can be imparted to the basic form of the curve.

Moreover, by making an additional minor modification to each of the basic equations, the position of the point of inflexion on the log exposure axis can be made invariant with asymmetry, that is by writing the following instead of equations (1) and (2) above respectively:

$$D=D_s/[1+(\{E_i/E\}^{\beta})/\alpha]^{\alpha} \quad (3)$$

$$D=D_s/[1+\exp(\beta' \log\{E_i/E\})/\alpha]^{\alpha} \quad (4)$$

The non-sensitometric density $D_f$, that is the fog and base densities, can then be introduced while at the same time preserving the underlying functional forms of the earlier equations by writing:

$$D=(D_s-D_f)/[1+(\{E_i/E\}^{\beta})/\alpha]^{\alpha}+D_f \quad (5)$$

instead of equation (3) and $$D=\frac{(D_s-D_f)}{[1+\exp(\beta'\log\{E_i/E\})/\alpha]^{\alpha}}+D_f \quad (6)$$

instead of equation (4).

It is then a matter of routine mathematical analysis to deduce that the speed, defined as the exposure $E_{sp}$ at which the second derivative of the curve reaches a maximum, is given by:

$$\log E_{sp}=\log E_i-(1/\beta)\log(A/2\alpha) \quad (7)$$

where $$A=(3\alpha+1)+[(5\alpha+1)(\alpha+1)]^{1/2} \quad (8)$$

Similarly, the exposure $E_{sh}$ at the shoulder of the curve, defined as the exposure at which the second derivative reaches a minimum, is given by:

$$\log E_{sh}=\log E_i+(1/\beta)\log(A/2\alpha) \quad (9)$$

The latitude λ of the curve can then be defined as $(\log E_{sh}-\log E_{sp})$ which gives:

$$\lambda=(2/\beta)\log(A/2\alpha) \quad (10)$$

The contrast of the system can be defined in two ways, firstly, as the slope g of the line joining the two points on the curve corresponding to the toe and shoulder as defined above, and, secondly, as the slope γ of the curve at its inflexion point. It is then found that:

$$g = (D_{sh}-D_{sp})/(\log E_{sh}-\log_{sp}) = \frac{\beta(D_s-D_f)[(1+\{2/A\})^{-\alpha}-(1+\{A/2\alpha^2\})^{-\alpha}]}{(2\log[A/2\alpha])} \quad (11)$$

and that $$\gamma=\beta(D_s-D_f)/(\log e[1+(1/\alpha)]^{\alpha+1}) \quad (12)$$

or, more simply:

$$\gamma=\beta'(D_s-D_f)/([1+(1/\alpha)]^{\alpha+1}) \quad (13)$$

In general, the latter expression for the contrast gives numerical values a little larger than those given by equation (11).

Although the significance of each parameter used in this disclosure is, for the most part, unequivocal and relates immediately to the scale or position of the characteristic curve on the log exposure axis, the two parameters α and β perhaps require some elucidation.

Firstly, as was stated earlier, α is a measure of the asymmetry of the curve. When α equals unity, the curve becomes a symmetrical sigmoid. When a is very large, the curve tends to a limiting form having a degree of asymmetry which, although at the maximum permitted by the particular algebraic form of the equation, is nonetheless of a magnitude not far in excess of the extreme observed in practice.

The parameter β, or perhaps more accurately its reciprocal, is essentially a measure of the latitude of the system because the only term apart from 1/β on the right-hand side of equation (10), 2log(A/2α), depends only on α and, because of the nature of the logarithmic function, is relatively insensitive to the actual value of α.

This insensitivity is readily demonstrated by calculating the limiting values of βλ for α values of unity and infinity from equation (10), and comparing these values with analogous results deduced from equations (11) and (12) for the two slopes g and γ.

In detail, if the corresponding latitudes $\lambda_g$ and $\lambda_g$ are defined as $(D_s-D_f)/g$ and $(D_s-D_f)/\gamma$, respectively, then equations (11) and (12) give:

$$\beta\lambda_g = (\log E_{sh}-\log E_{sp}) = \frac{(2\log[A/2\alpha])}{[(1+\{2/A\})^{-\alpha}-(1+\{A/2\alpha^2\})^{-\alpha}]} \quad (14)$$

and $$\beta\lambda_\gamma=(\log e[1+(1/\alpha)]^{\alpha+1}) \quad (15)$$

The limiting values of these three measures of latitude, each multiplied by β, are shown in Table 1 below. The fact that they are all little different from unity can be taken as a demonstration that β may be regarded in broad terms as the maximum slope of the normalized characteristic curve and, as such, is almost independent of the asymmetry parameter

α.

TABLE 1

| α | βλ | βλg | $\beta\lambda_v$ |
|---|---|---|---|
| 1 | 1.1439 | 1.9814 | 1.7372 |
| ∞ | 0.8360 | 1.3714 | 1.1805 |

Figure 12:
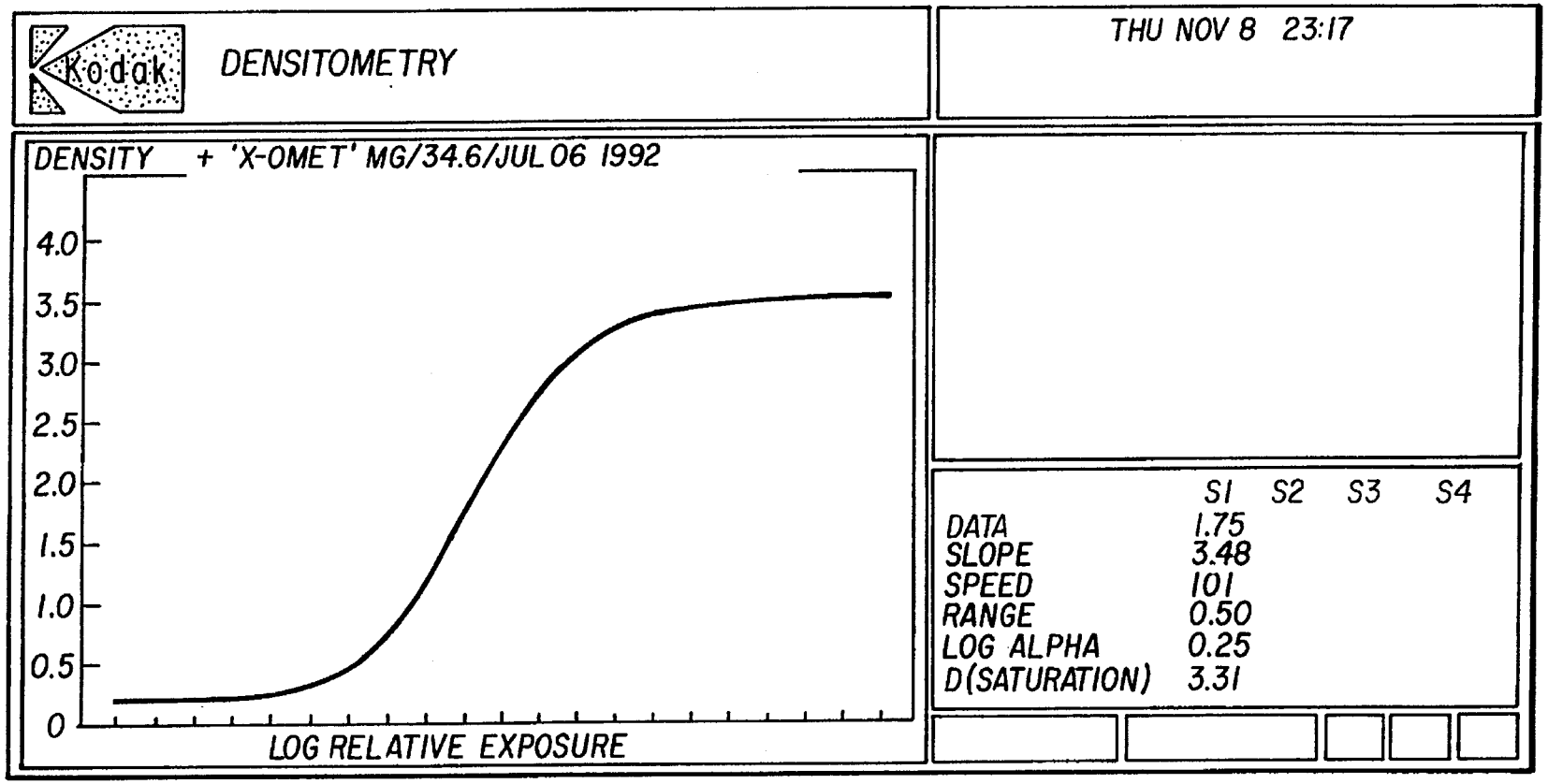
FIG. 12 is a screen obtained when using the method of the present invention.

FIG. 12 is a screen dump from an experimentally modified version of the KODAK 'X-Omat' Process Control Manager. It illustrates the use of the above equation (3) to fit data points measured in a typical radiographic system.

We claim:

1. A method of controlling photographic processing apparatus to process a given photographic material comprising the steps of:

producing a control strip of said given photographic material by exposing the control strip to a step wedge;

processing the exposed control strip in the processing apparatus to be exposed;

measuring the density values of the processed control strip;

determining a characteristic curve of the given photographic material, said curve defined by $$D=D_s/[1+(\{E_i/E\}^{\beta})/\alpha]^{\alpha}$$

where

E is the exposure,

D is the density at exposure E, $E_i$ is the exposure at the point of inflexion of the curve, $D_s$ is the density at saturation, α is a constant related to the asymmetry of the characteristic curve, and β is a constant related to the slope of the curve at the inflexion point by plotting the densities measured in said measuring step in relation to the exposures applied to said control strip in said producing step;

determining from said characteristic curve at least the slope, speed, latitude and $D_s$ parameters of said given photographic material; and controlling said photographic processing of said given photographic material by said photographic processing apparatus as a function of said slope, speed, latitude and $D_s$ parameters of said given photographic material.

* * * * *